US005719362A

United States Patent [19]

Gray, Jr.

[11] Patent Number: 5,719,362

[45] Date of Patent: Feb. 17, 1998

[54] TIMER CONTROL DEVICE FOR WALL MOUNTED TOGGLE SWITCH

[76] Inventor: Robert C. Gray, Jr., 2246 Wynnewood Cir., Louisville, Ky. 40222

[21] Appl. No.: 579,965

[22] Filed: Dec. 28, 1995

[51] Int. Cl.[6] ..... H01H 43/00

[52] U.S. Cl. ..... 200/38 R; 307/141; 315/362

[58] Field of Search ..... 200/11 R, 17 R, 200/19 R, 20, 21, 28, 30 R, 19 A, 33 R, 35 R, 36, 38 R, 38 A, 38 F, 38 B, 38 BA, 38 E, 39 R, 40, 50.01, 52 R, 500–502; 307/112, 116, 126, 119, 122, 134, 139–141, 141.4, 149, 150; 315/149, 159, 362

[56] References Cited

U.S. PATENT DOCUMENTS

| | | | |
|---|---|---|---|
| 2,515,932 | 7/1950 | Stang et al. | 200/167 |
| 2,524,215 | 10/1950 | Wegehoft | 200/172 |
| 3,171,920 | 3/1965 | Klein et al. | 200/92 |
| 3,179,396 | 4/1965 | Bracken | 267/1 |
| 3,818,156 | 6/1974 | Augustyniak | 200/33 R |
| 3,985,982 | 10/1976 | Schneidinger | 200/33 R |
| 4,508,943 | 4/1985 | Pfeiffer et al. | 200/17 R |
| 4,835,413 | 5/1989 | Nilssen | 307/141 |
| 4,912,376 | 3/1990 | Strick | 315/362 |
| 5,397,869 | 3/1995 | Huen | 200/330 |

*Primary Examiner*—Cassandra C. Spyrou
*Assistant Examiner*—Michael A. Friedhofer
*Attorney, Agent, or Firm*—Wheat, Camoriano, Smith & Beres, PLC

[57] ABSTRACT

A control device for controlling the time sequence activation of a wall mounted toggle switch is mounted directly to the toggle switch cover plate. The device is then programmed to turn the switch on and off in accordance with the programmed entry instructions. A sliding plate within the device contacts and moves the toggle into its on and off position in accordance with the program. The housing of the device defines an opening large enough for the toggle to be manually manipulated without removal of any components of the device.

19 Claims, 5 Drawing Sheets

TIMER CONTROL DEVICE FOR WALL MOUNTED TOGGLE SWITCH

BACKGROUND OF THE INVENTION

This invention relates to a timer control device and more particularly, to a timer control device that can be secured to a wall mounted toggle switch plate and automatically operate the toggle switch in accordance with a predetermined timed program.

While there are numerous control devices for controlling individual lights and appliances in accordance with predetermined programs, little, if any, progress has been made to control the turning "on and off" of circuitry connected to wall mounted toggle switches. Those that have been developed appear to be either cumbersome in operation or necessarily "hardwired" to the existing circuitry connected to the toggle switch. Such prior art control devices are inconvenient when the user wants to operate the toggle switch manually due to, for example, the failure of the timer control device to function properly. Access to the toggle switch requires complete removal of the timer control device.

An early attempt at providing for a toggle switch controlling device is found in U.S. Pat. No. 2,524,215 issued on Oct. 3, 1950 to Wegienhoft. The patent describes a device that moves the toggle in one direction but apparently not the other. Thus, the device either turns the switch on or off, but not both. Similarly, U.S. Pat. No. 3,179,396 issued on Apr. 20, 1965 to Bracken describes a time delay device that moves a toggle in a single direction. U.S. Pat. No. 3,171, 920 issued Mar. 2, 1965 to Klein et al describes a two way controlling device for a toggle switch as provided in circuit breakers, but is clearly too cumbersome to be adapted in any practical matter for use with wall mounted toggle switches. Finally, U.S. Pat. No. 5,397,896 issued on Mar. 14, 1995 to Huen and assigned to Qesco International describes a device that can be clamped to the face plate of a wall mounted toggle switch. The toggle itself can be moved from its off and on positions in accordance with a programmed time sequence by a toggle actuating device. The toggle actuating device is a claw that encloses the toggle and is driven by a linked follower connected to a circular toothed cam rotated by a motor. Provision is made for indirect manual operation of the toggle when desired through a manual override switch that causes a motor to drive the toggle actuating device. However, the toggle itself is covered and cannot be reached by the user. Should the device itself fail, it would be necessary to remove the entire device in order for the toggle switch to be turned of or on as the case may be. Moreover, the toggle actuating device causes the device to vary from a desired flat profile and extend from the wall mounting the toggle switch a distance greater than desired. Furthermore, to provide the necessary clamping, the device of the '896 patent requires that the face plate of the toggle switch be removed, a special spacer plate be installed, and the face plate reinstalled over the spacer plate.

Thus, it is a paramount object of the present invention to provide for a timer controller device that can be mounted against the face plate of a wall mounted toggle switch without additional fasteners or accessories. Moreover, it is a further object of the present invention to provide for a timer controller device with a compact toggle actuating device that minimizes the extent the device extends outward from the toggle switch or the "thickness" of the controller device. It is still another important object of the present invention to provide for the optional direct manual or automatic manipulation of the toggle switch without removal of the timer control device.

SUMMARY OF THE INVENTION

The above objects and other advantages are provided by a timer control device that is mounted directly to the face plate of a wall mounted toggle switch. The device advantageously uses one or more of the threaded bolts of the toggle switch obviating the need for cumbersome additional fasteners and any need to remove the switch face plate to secure the device to the toggle switch. The timer control device further provides for movement of the toggle through the use of a flat sliding movable member having first and second operating modes that engages and moves the toggle when the movable member is in the first operating mode. The driving elements of the movable member are largely in the same plane of movement of the flat sliding member. Thus, the flat profile of the movable member minimizes the "thickness" or depth occupied by the device extending outward from the toggle switch wall plate. In the second mode, the movable member is not in engagement with and does not operate the toggle and thus permits the toggle to be accessed directly by the operator and manually operated. The control device further has a timer and a controller that operates the moving member in accordance with a prescribed timed program so that the toggle switch is turned on and off automatically. It is further contemplated that the device carry replaceable batteries so that it is not necessary for the device be hard wired to the energy source connected to the switch itself.

DETAILED DESCRIPTION OF THE PREFERRED EMBODIMENT

Figure 1:
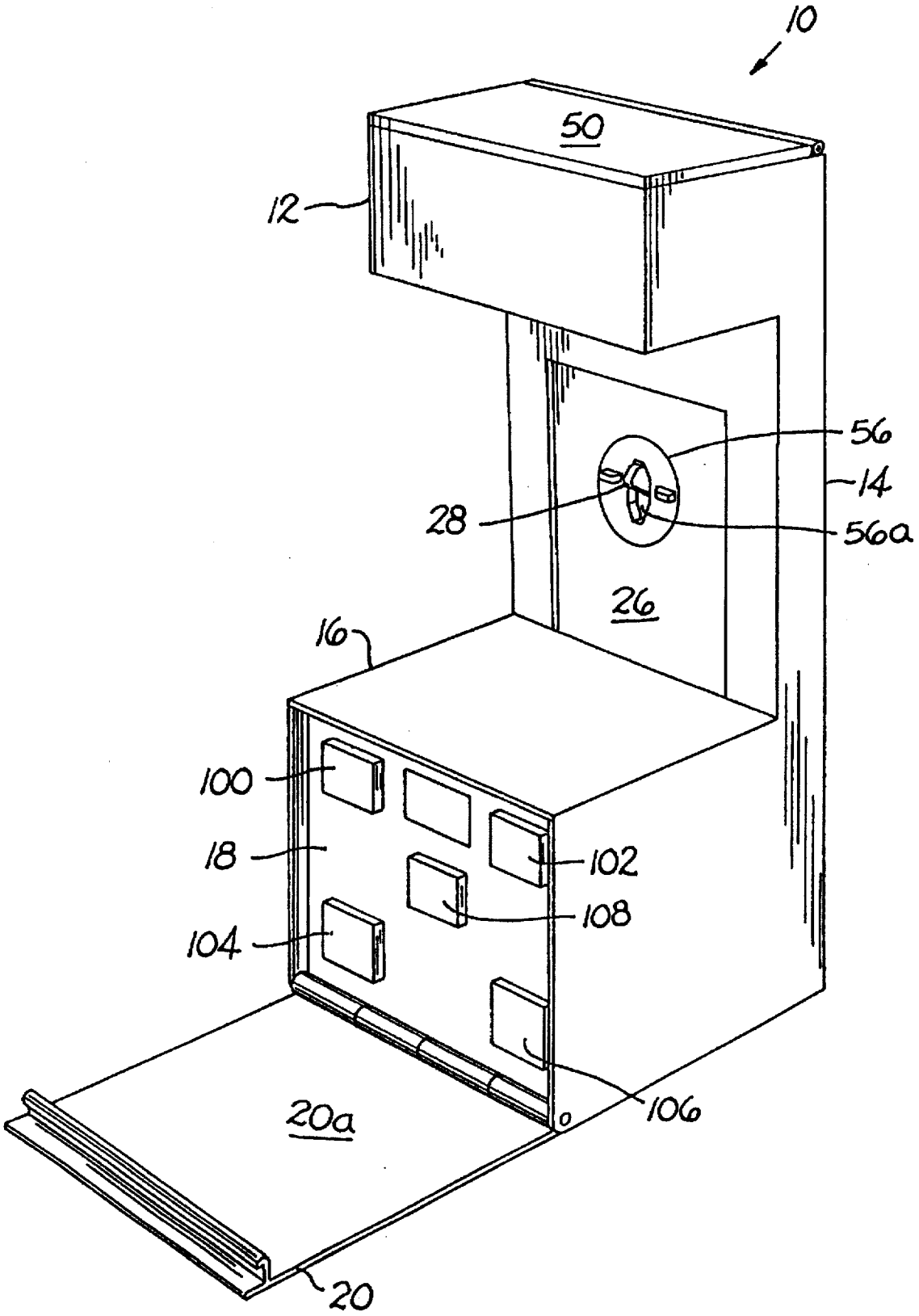
FIG. 1 is a front perspective of a timer control device in accordance with the present invention.

The perspective of FIG. 1 illustrates the control device, generally shown by the character numeral 10 as being a unitary apparatus comprised of several major components, a top battery housing 12, a central housing 14 mounting components for manipulating the toggle of a wall mounted toggle switch, a main housing 16 enclosing the various power components and control circuitry and mounting an operating control panel 18, and a cover 20. Normally closed cover 20 is pivotally mounted to the housing 16 at the bottom edge thereof and has operating instruction indicia on the interior surface 20*a* thereof. The pivoting arrangement may be a hinge and pin connection as illustrated or any other arrangement as desired. The operating control panel 18 forms the front side of housing 16 and is accessible when cover 20 is open as shown. Access to the interior of battery housing 12 is facilitated by hinged lid 50.

Figure 2:
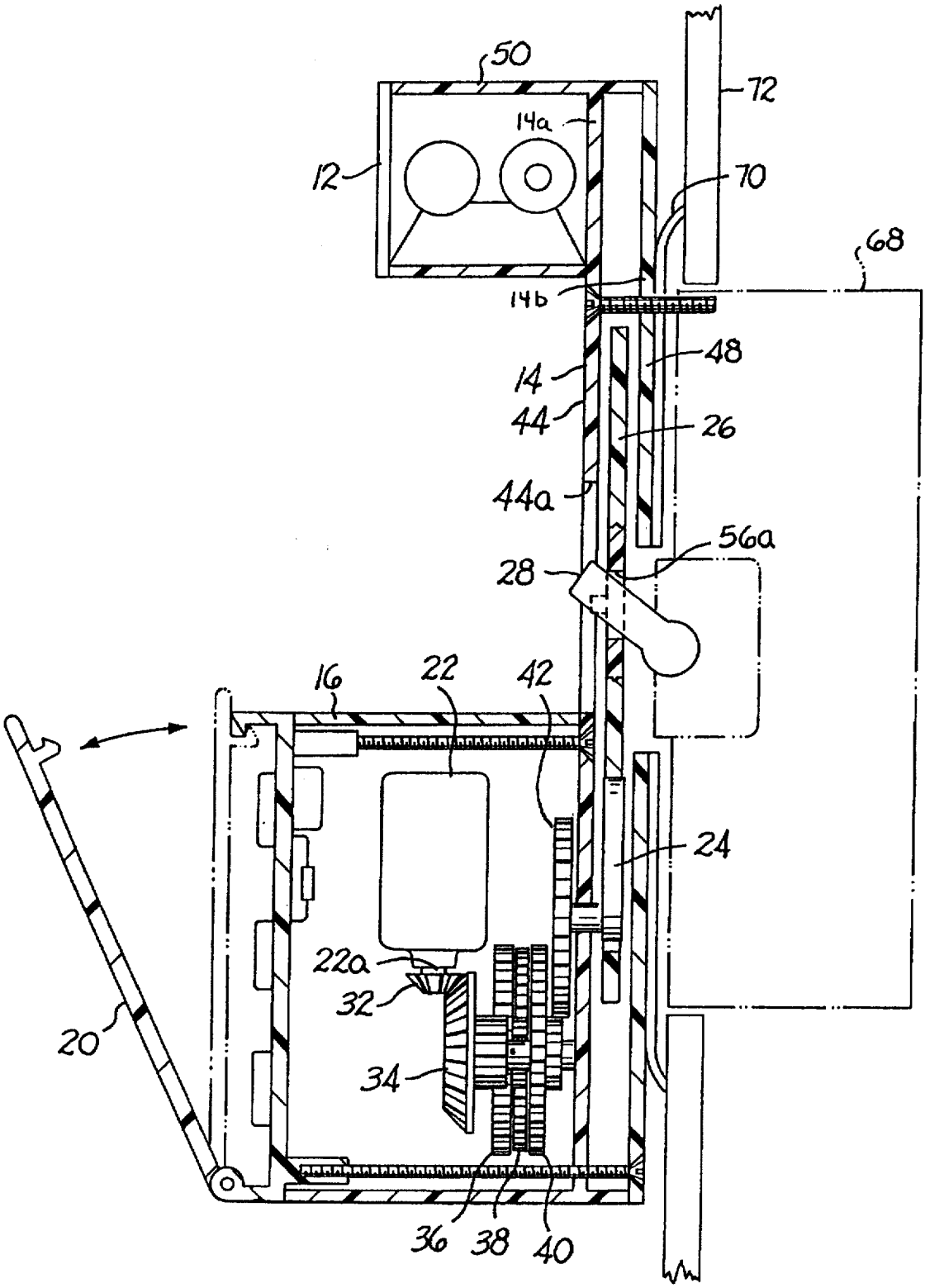
FIG. 2 is a side sectional view of the timer control device of FIG. 1.

As is clear from the views of FIGS. 1 and 2, the central housing has a smaller depth, i.e., thickness, than the battery housing 12 and the main housing 16. The central housing 14 also separates the battery housing 12 and main housing 16 a distance sufficient for the fingers of a user to reach and manipulate components mounted by the central housing 14. It is contemplated that the present device can be mounted directly to the switch plate 70 of a typical wall mounted toggle switch 68 that is located to the interior of room wall 72 by using an elongated bolt 74 inserted through both the front and rear walls 14*a*, 14*b* of the central housing 14 and fastened into an upper threaded receptacle (not shown) of the toggle switch 68.

Referring now to FIGS. 2, 3, 4, 5, 6 and 7, it may be seen that a motor 22 is mounted within main housing 16 and is operatively connected by a series of gears to a cam operating arm 24. Electromotive energy is supplied to motor 22 by a plurality of batteries 30 shown mounted within battery housing 12. As described in detail below, cam arm 24 reciprocally drives a sliding plate 26 largely positioned between a wall 44, functioning as the front wall of housing 14, and a wall 48, functioning as the rear wall for the entire device 10, in an up-and-down direction. Toggle 28 extends through an opening 56*a* defined by a disk 56, mounted in plate 26, and through a cut-out section 44*a* in wall 44. Disk 56 is mounted for rotary movement in a complimentary opening 26*a* (illustrated by a bracket in FIG. 6*e*) within plate 26. Toggle 28 abuts the sides of the opening 56*a* in one operating mode (in which the elongated direction of opening 56*a* is essentially horizontal as in FIG. 6*c*), and thus is caused to move in the same direction of movement of sliding plate 26.

Figure 3:
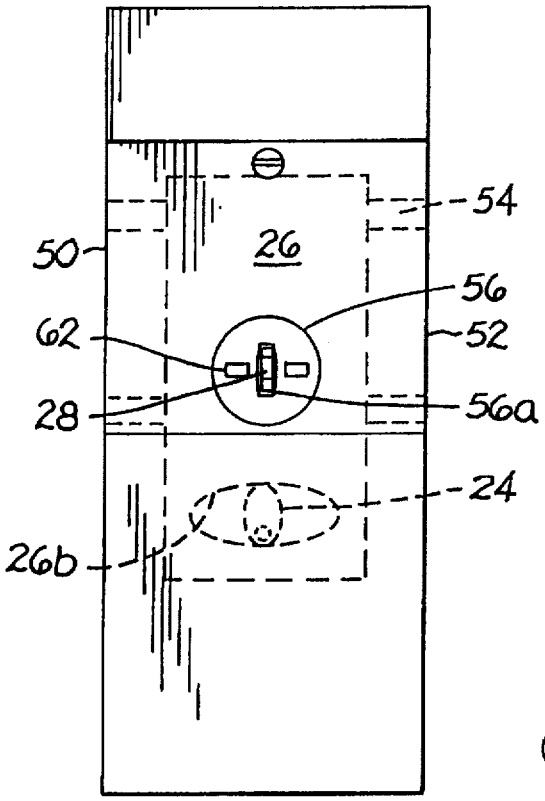
FIG. 3 is a front elevation view of the timer control device of FIG. 1.
Figure 5:
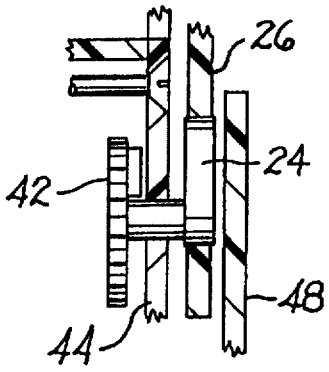
FIG. 5 is a side sectional view illustrating the relationship of the sliding plate and cam arm and gear.

As best seen in FIG. 2, a motor 22 through a series of connecting gears provides the drive to plate 26. The output shaft 22*a* of motor 22 rotates a bevel gear 32 which engages the first gear 34 of a series of intermediary interconnected gears 36, 38 and 40 that drive cam arm gear 42. To save space, gears 36 and 40 are stacked. Each of the shafts of gears 34 through gear 40 are mounted to wall 44 as shown. The enlarged sectional view of FIG. 5 depicts cam arm 24 being positioned between walls 44 and 48 and keyed to a shaft 42*a* mounted to and extending through wall 44. From the views of FIGS. 3 and 7, it may be seen that sliding plate 26 also defines an elliptically shaped second opening 26*b*, the perimeter of which functions as a cam follower edge for cam arm 24. Cam arm 24 is positioned for rotational movement with in the elliptic opening 26*b* and engages the elliptical edge to cause the sliding plate 26 to move either up or down between walls 44 and 48. Plate 26 is guided by a plurality of guides 54 mounted between side walls 52 as illustrated in FIG. 3.

Figure 4:
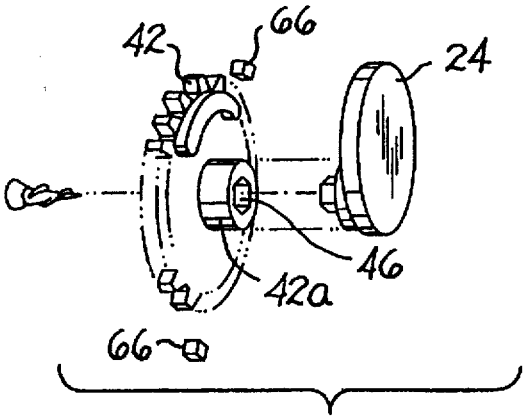
FIG. 4 is an exploded perspective of the cam arm and gear used to drive a sliding plate that operates the toggle of the toggle switch member.
Figure 7:
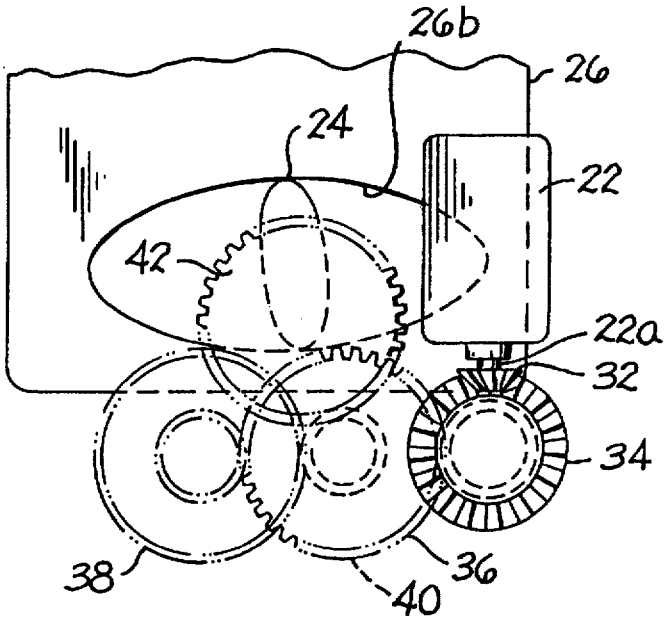
FIG. 7 is a schematic of the gearing arrangement with the cam arm, motor, and sliding plate.

Cam arm 24 is keyed within bore 46 of shaft 42*a* to cam arm gear 42 as portrayed in FIG. 4 so that it rotates with gear 42. As discussed in more detail below, gear 42 may carry a pair of magnetic switches 66 that interact with the control circuitry to signal a controller that cam arm 42 has pivoted a predetermined distance.

Figure 6A:
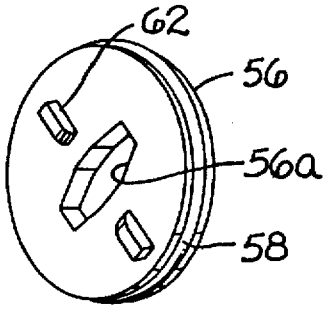
FIG. 6*a* is a perspective view of a circular member mounted to the sliding member wherein the rotational position of the circular member permits the toggle to be operated either manually or automatically.
Figure 6B:
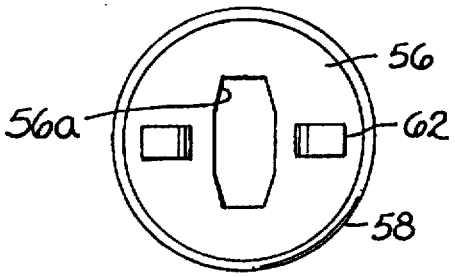
FIG. 6*b* is a front view of the circular member in the manual operating position.
Figure 6C:
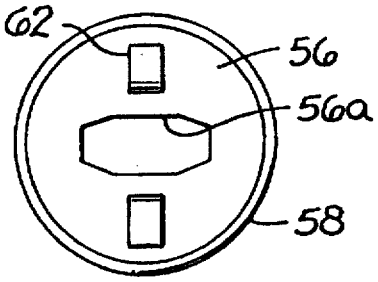
FIG. 6*c* is a front view of the circular member in the automatic operating position.
Figure 6D:
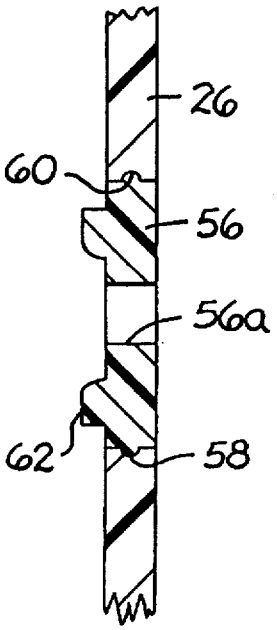
FIG. 6*d* is a side sectional view of the rotating member mounted to the sliding plate.
Figure 6E:
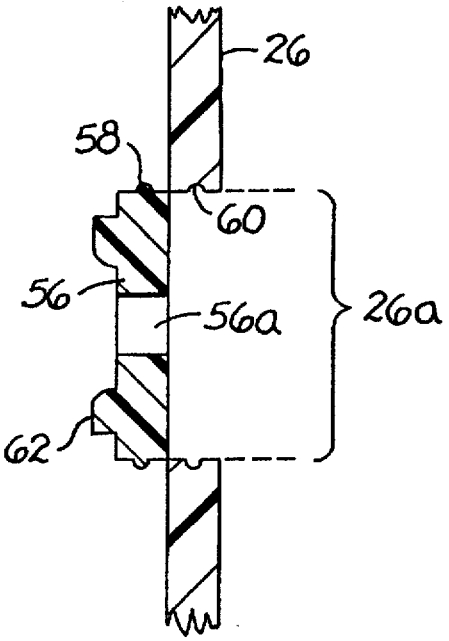
FIG. 6*e* is an exploded section view of the rotating member adjacent the sliding plate.

As stated above, member 56 is mounted for rotational movement relative to sliding plate 26. Slot 56*a*, through which the toggle 28 extends, is elongated. To best describe the relationship of rotating member 56 to the toggle 28 and the use thereof, specific reference is made to FIGS. 6*a*–6*e*. Slot 56*a* has a width large enough to permit toggle 28 to extend and abut the sides of the slot. When the slot is positioned so that its length extends horizontally as in FIG. 6*c*, the toggle 28 moves as plate 26 moves. However, when the member 56 is oriented so that the length of slot 56*a* extends vertically as in FIG. 6*b*, the toggle can be manually manipulated from one position to the other. FIG. 6*d* shows that the rotating member 56 is a disk that may be snap fitted within the complimentary circular opening 26*a* of the sliding plate 26. As best seen in FIG. 6*e*, member 56 may be provided with a circumferentially extending protrusion or tongue 58 that fits within a groove 60 extending around the circumference of the opening, thus permitting the member 56 to be rotated as desired. Tabs 62 serve as finger grips to facilitate rotation of member 56.

Even from a cursory review of FIG. 2, it is clear that the moving parts of the timer control device 10 occupy little space measured from the face plate 70. The cam arm 24, elliptical cam opening, the sliding plate 26, rotating member 56, and slot 56*a* all have movement in essentially the same plane, i.e., have an essentially co-planar relationship. This essentially co-planar relationship takes up minimal depth and permits control device to have a flat profile against face plate 70.

Figure 8:
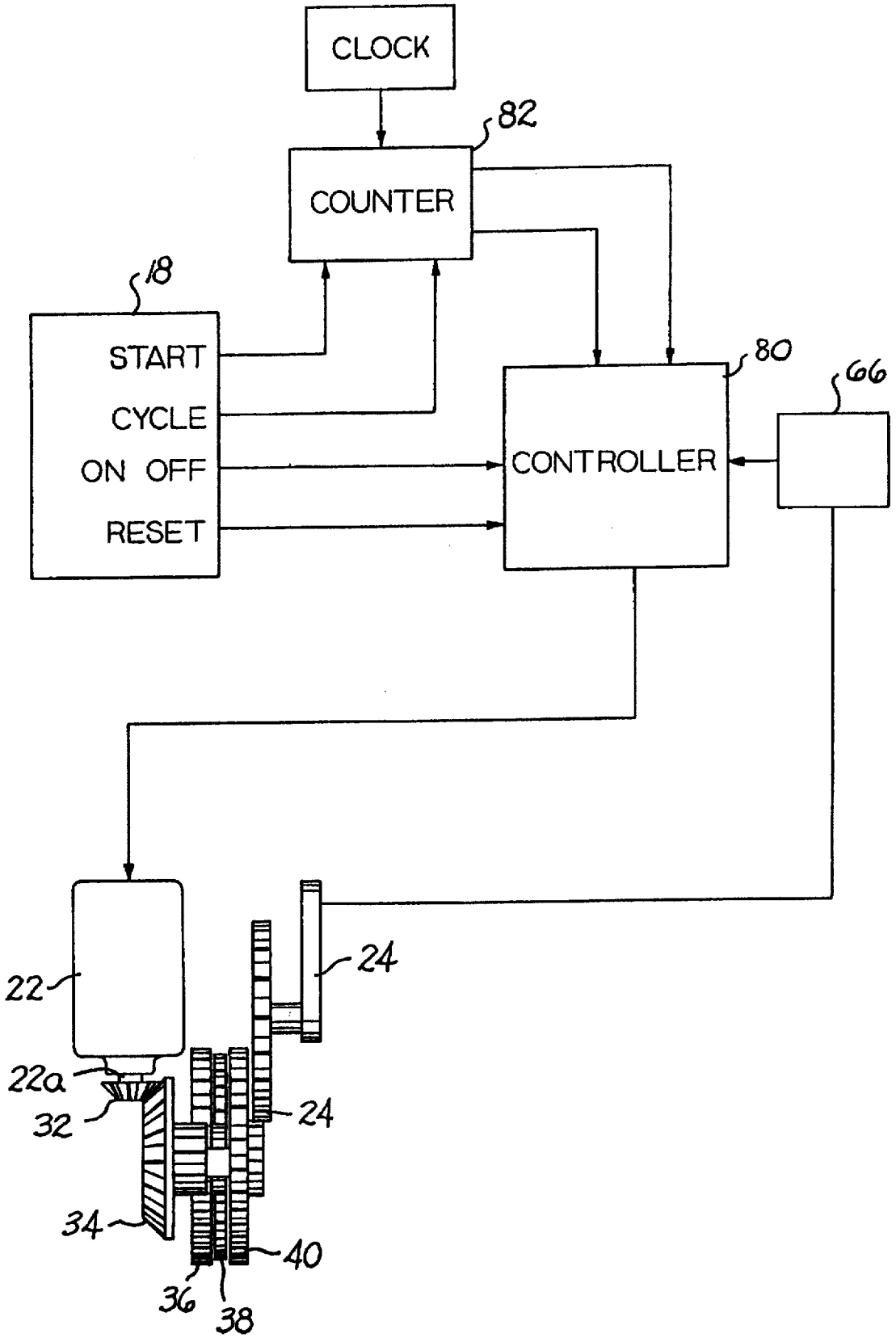
FIG. 8 is a block diagram of the controller, counter and keypad coupled with a schematic of the motor, gearing and cam arm.

For the operating sequence of control device 10, reference is now made to FIGS. 1 and 8. To operate the timer device 10, cover 20 is pivoted open, exposing the control panel 18. Typical instructions for user friendly operation are set forth on the interior surface 20*a* and may instruct the user to set the time by first pressing the reset key 108 to clear the system and set the timer to zero. Next, the start time key 100 is pressed to set the time in one hour increments in counter 82. The program may start from one hour to 12 hours from the time of the first entry. Then the on-cycle key 102 is pressed to advance the hour units up to 15 hours. This cycle is then automatically repeated each 24 hour period until changed by the user or until batteries are removed or depleted. Finally, the device can be turned on or off without program interruption by pressing the on key 104 or the off key 106. Reset key 108 may be depressed when the device needs to be reset for other and different time intervals.

When controller 80 determines that a cycle sequence is to start, motor 22 is activated until cam arm 24 has rotated about 180° causing the sliding plate 26 to move against toggle 28 to close the toggle switch. The controller 80 then is provided a signal from microswitch 66 and the motor 22 is deactivated. Rotary member 56 remains in a first mode position in which slot 56*a* is essentially horizontal. Following a predetermined time period, motor 22 is again activated to cause plate 26 to move in the opposite direction thus opening the toggle switch and the controller is again signalled via switch 66 and the motor 22 deactivated.

In the event that the user determines that it is desirable to manually open or close the toggle switch, the user can reach into the interior of the device between the battery housing 12 and main housing 16 and rotate member 56 into its second mode of operation in which the slot 56*a* is essentially vertical. Then the toggle 28 can be manually moved into the off or on position as desired. Although the program in device 10 can be overridden by depressing the off key 106 to de-energize the system, the deactivation can be accomplished without interruption of the program by merely rotating member 56 into a position in which slot 56*a* is vertical. Movement of plate 26 then is ineffective to move toggle 28.

It should be understood that the instructions and programming as set forth above are for the simplest of operations. It is contemplated that the present timing device may be programmed for more complex cycle arrangements. Moreover, it is contemplated that the control device could be made applicable for use with multiple toggle switch apparatus without departing from the invention as claimed.

I claim:

1. A timer control device for a toggle activated switch removably attached to a switch plate of said switch mounted on a wall comprising a housing removably fastened over and to said switch plate;

a plate movable with respect to said switch plate and defining a slot through which a toggle of said toggle switch extends said slot having sides essentially abutting said toggle when said plate is in an operating mode position;

a plate drive for driving said plate;

a controller for establishing a predetermined time period said plate drive responsive to said controller for moving said plate when in said operating mode in a first direction to cause said toggle switch to move to a first position at a start of said time period and to a second position an end of said time period; and a toggle mode operating member selectively moving said plate between said operating mode in which said slot sides are abutting said toggle and a nonabutting mode in which said slot sides are out of contact with said toggle thereby permitting manual manipulation of said toggle.

2. The device of claim 1 in which said housing defines an opening permitting direct access to said toggle switch for manual manipulation of said toggle.

3. The device of claim 1 in which said plate drive includes a motor and circuitry connecting said motor to batteries supplying electromotive energy to said motor, said movable plate causing a motor cut off switch to open after said movable plate has moved said toggle switch between said positions and stopping further operation of said motor.

4. The device of claim 1 in which said toggle mode operating member is a circular disk defining said slot and mounted for rotary motion within a complimentary opening defined by said movable plate, said slot being elongated wherein said slot is positioned with said slot's long dimension essentially horizontal when said disk is in said first position and essentially vertical when said disk is in said second position.

5. The device of claim 4 in which said disk has finger tabs to facilitate manual rotation of said disk.

6. The device of claim 1 including a drive motor said movable plate having an opening defining a cam edge and said plate drive including a cam arm positioned within said opening and having a distal end abutting said cam edge, said cam arm operatively connected to said drive motor and moving said movable plate when said motor is operative.

7. A timer control device for a wall mounted toggle switch comprising (a) a first member removably secured to a face plate of a wall mounted toggle switch, said first member having a wall which defines an opening through which a toggle of said wall mounted toggle switch extends when said first member is fastened to the face plate;

(b) a movable member spaced from said wall and having first and second operating modes, said movable member engaging a toggle of said toggle switch when said movable member is in said first mode and said first member is fastened to the face plate, said second member positioned out of engagement of said toggle when in said second made thereby permitting said toggle to be manipulated manually;

(c) a drive for moving said movable member between first and second positions when said movable member is said first mode thereby moving the toggle between off and on positions;

(d) a timer for activating and deactivating said drive member in accordance with a predetermined time period; and (e) a controller for setting the predetermined time period.

8. The timer control device of claim 7 in which said movable member defines a slot through which said toggle extends when said first member is fastened to the cover plate.

9. The timer control device of claim 8 in which said slot is elongated, said slot having a long axis oriented essentially horizontal when said movable member is in the first mode and essentially vertical when said movable member is in the second mode.

10. The timer control device of claim 9 in which said movable member comprises a plate mounted for movement across said face plate when said first member is fastened to said face plate and a rotating member defining said slot, said rotating member mounted to said plate for rotational movement relative to said plate.

11. The timer control device of claim 10 in which said drive member in response to said timer reciprocates said plate across a surface of said face plate when said first member is fastened to said face plate and said rotating member is positioned so that said slot is essentially horizontal.

12. The timer control device of claim 11 in which said drive member comprises a rotating cam arm and said plate has a cam surface abutting said cam arm and moving linearly in response to rotational movement of said cam arm.

13. The timer control device of claim 12 including a first housing connected to one end of said first member and a second housing connected to another end of said first member, said first housing enclosing at least one battery and said second housing enclosing a motor operatively connected to said rotating cam arm and said controller.

14. In combination, a wall mounted toggle switch having a face late secured to a switch receptacle by at least one threaded bolt and through which a toggle extends, and a timer control device for moving said toggle between off and on positions for respectively opening and closing said switch, said control device comprising a first member secured to said face plate and defining an opening through which said toggle extends, a movable member having first and second operating modes, said movable member engaging said toggle when said movable member is in said first mode and moving said toggle between said off and on positions, said movable member positioned out of engagement of said toggle when in said second mode thereby permitting said toggle to be manipulated manually;

a drive member for selectively moving said movable member between first and second positions when said movable member is in said first mode thereby moving said toggle between said off and on positions;

a timer for activating and deactivating said drive member in accordance with a predetermined time period; and a controller for setting the predetermined time period.

15. The combination of claim 14 in which said first member is fastened to said face plate by a threaded bolt secured to said switch receptacle.

16. The combination of claim 14 in which said movable member defines a slot through which said toggle extends when said first member is fastened to the cover plate.

17. The combination of claim 16 in which said slot is elongated and has a long axis oriented essentially horizontal when said movable member is in the first mode and essentially vertical when said movable member is in the second mode.

18. The combination of claim 17 in which said movable member comprises a plate mounted for movement across said face plate when said first member is fastened to said face plate and a rotating member defining said slot, said rotating member mounted to said plate for rotational movement relative to said plate.

19. The combination of claim 18 in which said drive member comprises a rotating cam arm and said plate has a cam surface abutting said cam arm and moving linearly in response to rotational movement of said cam arm.

* * * * *